US006491581B1

(12) United States Patent
Mankowski

(10) Patent No.: US 6,491,581 B1
(45) Date of Patent: Dec. 10, 2002

(54) ROOF VENTILATOR AND FILTER

(76) Inventor: John P. Mankowski, 574 Swan River Rd., Bigfork, MT (US) 59911

( * ) Notice: Subject to any disclaimer, the term of this patent is extended or adjusted under 35 U.S.C. 154(b) by 0 days.

(21) Appl. No.: 09/602,613

(22) Filed: Jun. 22, 2000

(51) Int. Cl.[7] ..... F24F 7/02
(52) U.S. Cl. ..... 454/365; 52/199
(58) Field of Search ..... 454/365, 366; 52/199; 55/524

(56) References Cited

U.S. PATENT DOCUMENTS 4,270,933 A * 6/1981 Meny et al. ..... 55/524 X
4,325,290 A * 4/1982 Wolfert ..... 454/365
4,336,038 A * 6/1982 Schultheiss et al.
4,903,445 A 2/1990 Mankowski ..... 52/199
5,070,771 A * 12/1991 Mankowski ..... 454/365 X
5,167,579 A 12/1992 Rotter ..... 454/365
5,174,076 A * 12/1992 Schiedegger et al. ... 454/365 X
5,458,538 A * 10/1995 MacLeod ..... 454/365
5,673,521 A * 10/1997 Coulton et al. ..... 454/365 X

* cited by examiner

*Primary Examiner*—Harold Joyce
(74) *Attorney, Agent, or Firm*—Barry L. Davison; Davis Wright Tremaine

(57) ABSTRACT

A roof ridge ventilator with filtering device to be installed under a cap shingle includes a one piece cover member of an elongated shape including a pair of flaps, each flap having one upper surface over which cap shingles are secured and also having downwardly facing lower surfaces, a pair of vents respectively secured to the lower surface of the cover member flaps, each vent including at least one set of shielded louvers having openings for deflecting air flow while maintaining a minimum free area for air passage such that the air flowing therethrough is substantially reduced in velocity to limit the infiltration of foreign matter. Longitudinally spaced supports extend substantially vertically to permit nailing onto the roof such that the vent does not collapse during installation and such that the net free area remains intact. A band of fibrous material positioned inboard of the vent to further prevent foreign matter for entering the attic.

19 Claims, 5 Drawing Sheets

ROOF VENTILATOR AND FILTER

BACKGROUND OF THE INVENTION

1. Field of the Invention

The present invention relates to roof ventilator in general, and more particularly, to a device and method for filtering foreign matter from external air passing through the roof ventilator.

2. Background

Roof ridge ventilators permit circulation of air through the roof of a building to decrease the temperature within the building and to allow for air circulation under the roof. Such ventilators are also desirable for the removal of moisture build-up within the enclosed cavity of the roof to prevent rotting of wooden and/or composite members. Commonly, ridged roofs will have an opening at the ridge communicating with the cavity. Ideally, the roof ridge ventilators protect the opening from the external environment while allowing air to freely circulate through the cavity.

Some currently available roof ventilators have external baffles used to deflect airflow away from the vents of the roof ventilator. That is, the external baffles do not filter air as it flows through the roof ventilator and, moreover, tend to be unsightly. In addition, other currently available ventilators use adhesives to attach various parts of the ventilator. Using adhesive tends to increase the complexity and cost of fabricating the ventilator. Moreover, adhesives tend to degrade relatively quickly over time due to the temperature cycling experienced by ventilators when installed, thereby decreasing the reliability of the ventilator.

One proposed ventilator to overcome these problems is set forth in U.S. Pat. No. 5,070,771, issued to Mankowski. Mankowski discloses a ventilator that includes a pair of flap covers hingedly connected by a hinge member integrally formed with each flap cover. Extending at an angle from the lower surface of each flap cover is a set of internal louvers (i.e., the louvers are under the covers when the ventilator is installed on a roof. Each louver includes openings extending there-through to permit the exchange of air. In addition, the louvers serve to filter the air as it flows through the ventilator. Although such a ventilator effectively vents the enclosed cavity of a roof, of course, further improvements are desirable.

One improvement that is desirable stems from recent changes in some state building codes. In response to extremely severe weather conditions, some state building codes have been amended to require that roof ventilators prevent infiltration of foreign matter into the enclosed roof cavity to which the ventilator is attached. A ventilator as disclosed in the aforementioned Mankowski patent meets such requirements for normal and even severe weather conditions. However, in extremely severe weather conditions (e.g., hurricanes), that ventilator may undesirably experience water leakage.

Thus, there exists a need for a roof ventilator that permits the free exchange of air within the roof cavity at a relatively low cost and with a high degree of performance and reliability under extreme weather conditions.

SUMMARY OF THE INVENTION

In accordance with the present invention, a roof ventilator is provided. The roof ventilator includes a cover member having a flap with a first surface over which shingles are secured and a second surface. The roof ventilator also includes a first set of louvers for deflecting airflow and reducing airflow velocity while maintaining minimum free area for air passage. Supports and a filter device are coupled to the cover member second surface. The supports extend from the second surface of the cover member flap at a height substantially equal to that of the first set of louvers to minimize interference with the first set of louvers by the supports. The filter device filters external air passing through the first set of louvers.

In accordance with other aspects of this invention, the filter device is a band of fibrous material and has a thickness that is substantially equal to the height of the supports.

In accordance with additional aspects of this invention, the filter device includes slits cut so as to be aligned with the supports when the filter device is attached to the cover member. The filter device is attached over the supports by the supports fitted into slits of the filter device.

In accordance with still yet other aspects of this invention, the roof ventilator further includes a second set of louvers located inboard of the supports. The second set of louvers have openings for further deflecting and reducing air flow velocity while maintaining a minimum free area for air passage.

A roof ventilator formed in accordance with the present invention has several advantages over roof ventilators used in the past. First, the filter device minimizes the passage of rain, insects, and dirt particles from entering the ventilated space while retaining the compact size and low cost of the roof ventilator. Second, the louvers deflect airflow while maintaining a minimum free area for air passage, such that the air flowing through the roof ventilator is substantially reduced in velocity to further limit the infiltration of foreign matter. Finally, because of its integrated design, a roof ventilator formed in accordance with the present invention can easily be manufactured and installed.

DETAILED DESCRIPTION OF THE PREFERRED EMBODIMENT

Figure 1:
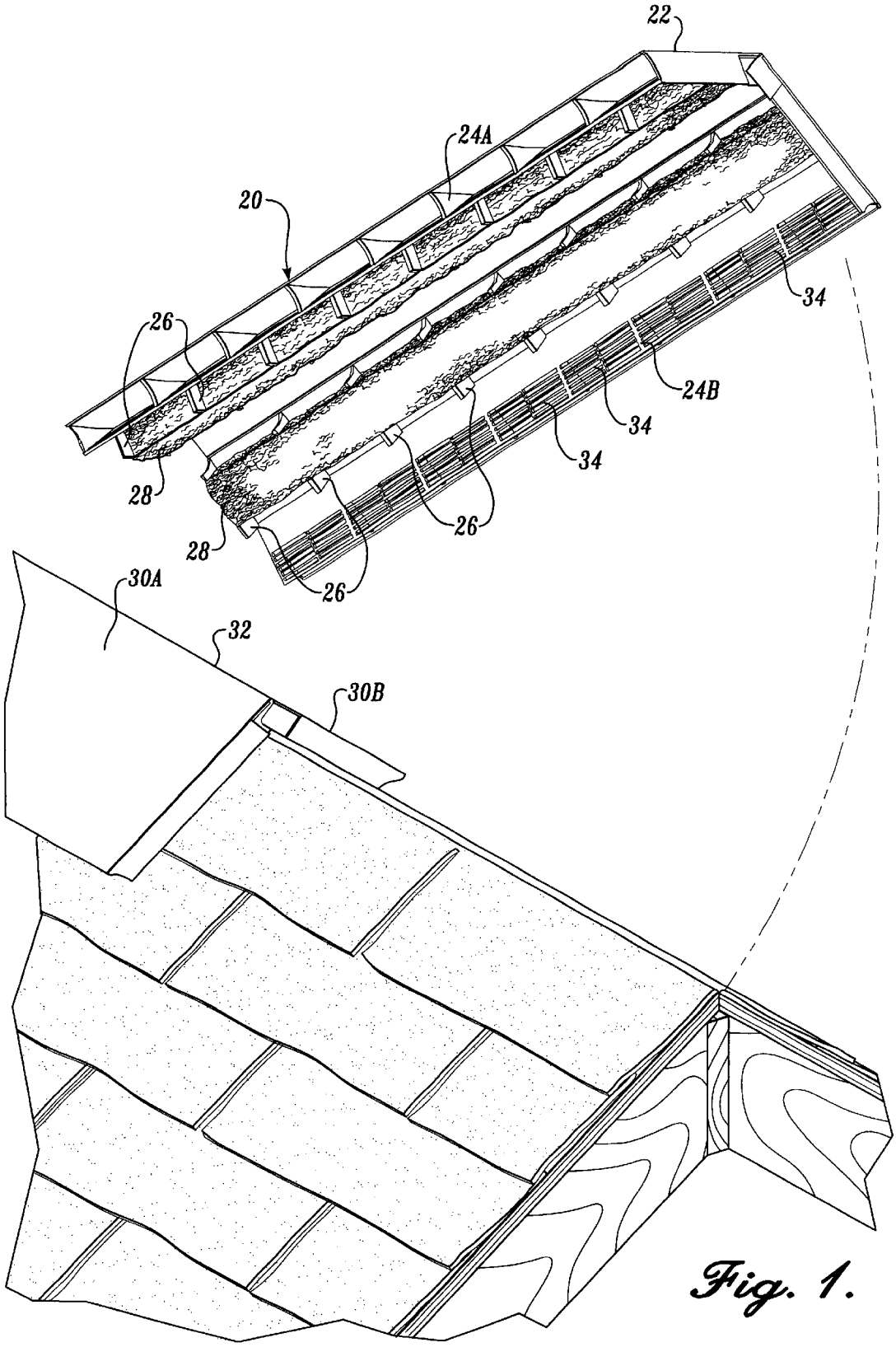
FIG. 1 is a perspective view of a roof ventilator formed in accordance with one embodiment of the present invention.
Figure 2:
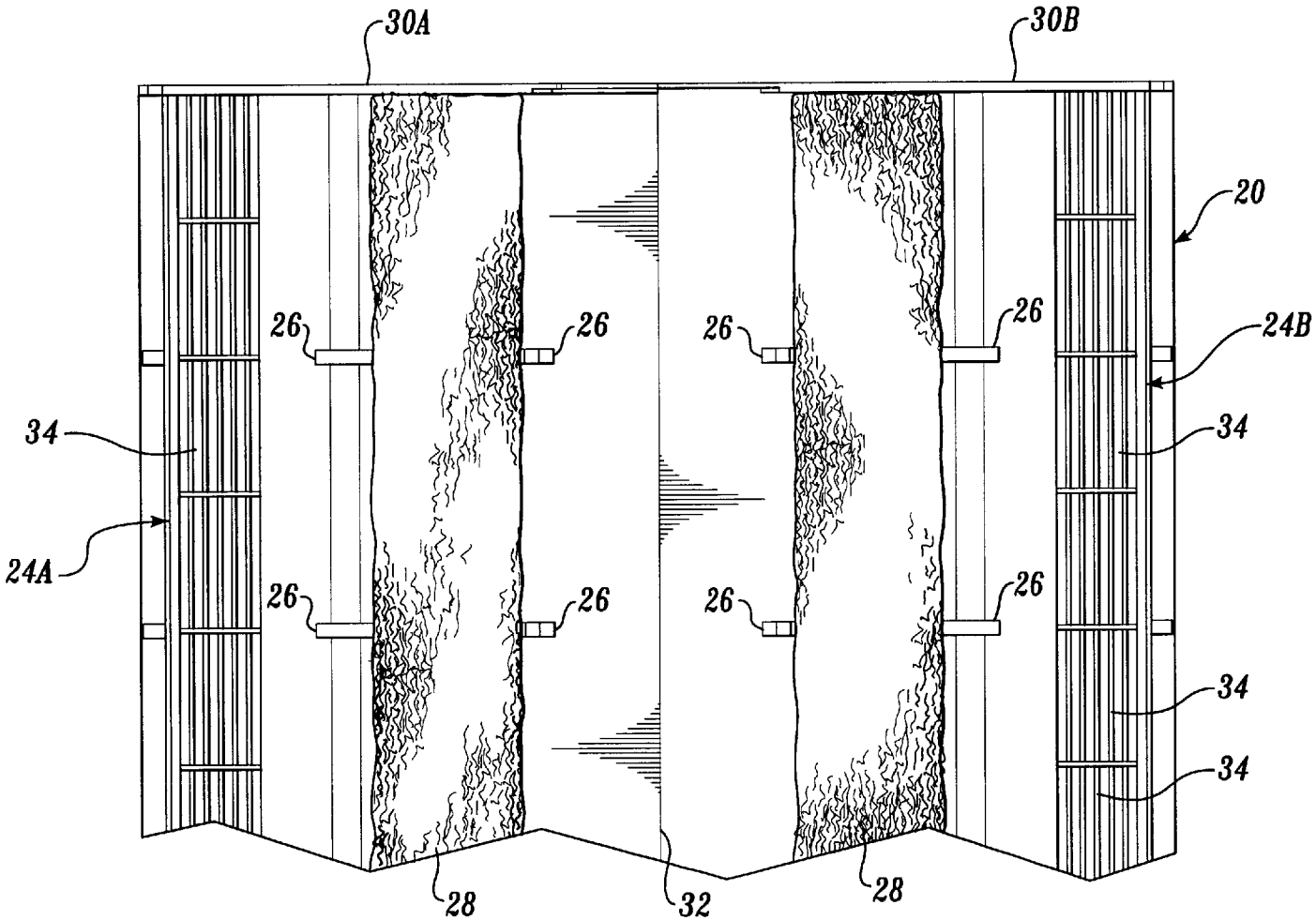
FIG. 2 is a partial bottom planar view of a roof ventilator formed in accordance with one embodiment of the present invention showing the filter device, louvers, and supports.

FIGS. 1 and 2 illustrate one embodiment of a roof ventilator 20 constructed in accordance with the present invention. The roof ventilator 20 includes a cover member 22, first and second louvers 24A and 24B, supports 26, and a filter device 28. Except for filter device 28 (described further below), roof ventilator 20 is suitably formed from a thermal plastic, such as polypropylene, or other materials such as nylon, epoxy resin, polyurethane or other plastics. Alternatively, roof ventilator 20 may be formed from a suitable metal such as aluminum or sheet steel.

The cover member 22 includes first and second flaps 30A and 30B and a hinge 32 extending longitudinally between the first and second flaps 30A and 30B. The hinge 32 is suitably integrally formed with the first and second flaps 30A and 30B to form a unitary body. The construction of the cover member 22 permits use of the roof ventilator 20 on roof ridges of varying pitches and angles. The roof typically contains an opening for venting the roof cavity. The roof ventilator 20 may be of any length, but is suitably four to five feet. In one embodiment, the roof ventilator 20 may be secured to a roof ridge by a cap shingle (not shown) by a well-known fastener (e.g., a nail, screw, tack, staple or other types of fasteners) extending through both the cap shingle and the roof ventilator 20.

The first and second set of louvers 24A and 24B are suitably integrally formed with the cover member 22 and include openings 34. Each opening 34 permits air circulation through the roof ventilator 20. Further, each opening 34 deflects airflow while maintaining a minimum free area for air passage, such that air flowing through the louvers 24A and 24B is substantially reduced in velocity to limit the infiltration of foreign matter. The openings 34 change the direction of airflow through the roof ventilator 20, such that airflow velocity within the roof ventilator 20 is reduced to substantially zero under normal conditions.

Still referring to FIGS. 1 and 2, the supports 26 will now be described in greater detail. Each of the supports 26 are substantially rectangular and are integrally formed with the lower surface of the cover member 22, such that, in this embodiment, each support 26 is substantially normal to the cover member 22. The supports 26 are spaced at predetermined locations along the length of the roof ventilator 20 to minimize their impact on air flowing through the roof ventilator 20. In this embodiment, at least one side of the roof ventilator 20 includes two rows of aligned supports, such that an inboard and outboard row of supports are disposed in space relationship on the lower surface of the cover member 22. As configured, filter device 28 may be disposed between the spaced inboard and outboard rows of supports. Although in this embodiment, the supports 26 are rectangular in shape and extend normally from the surface of the cover member 22, in other embodiments, the supports can extend from the cover member at any suitable angle or shape so long as the configuration does not interfere with the roof ventilator 20 being properly mounted to the roof.

The filter device 28 is suitably formed from various fibrous materials, such as fiberglass, plastic fibers, natural fibers and coated natural fibers. The fibers may be loosely woven, or may be unwoven and held together with a binding material. In one embodiment, the fibrous material is the same as that used in SPEEDVENT vent products available from Northwest Building Products, Madison Heights, Mich. The fibrous material may include a backing or mesh on one or both sides to provide additional structural support for the filter device to hold its shape. In this particular embodiment, the filter device 28 is substantially rectangular in shape and may be adhesively or mechanically fastened between the inboard and outboard rows of the supports 26. As fastened between supports of the supports 26, the filter device 28 extends the length of the roof ventilator 20. The filter device 28 further minimizes infiltration of foreign matter into the roof to which the roof ventilator 20 is mounted, while still allowing ventilation. In this embodiment, the filter device 28 is advantageously placed away from the opening in the roof ridge so that the fibrous material will not sag or otherwise fall into the roof ridge opening.

Figure 3:
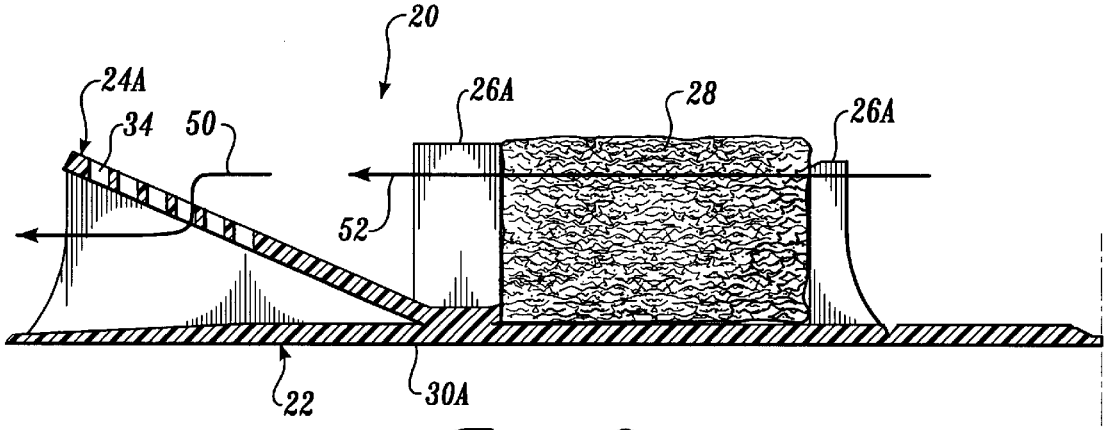
FIG. 3 is a cross-sectional end view of a roof ventilator formed in accordance with one embodiment of the present invention, showing placement and attachment of a filter device.

Operation of the roof of ventilator 20 may be best understood by referring to FIG. 3. For clarity, this description is for one half of the ventilator (i.e., the half containing louvers 24A), with the operation for the other half (i.e., the half containing louvers 24B) being essentially identical. In ventilation operation (i.e., when conditions tend to allow air to flow out of the ventilator), air tends to flow from the roof ridge opening toward the cover member 22. This airflow is typically caused by convection and/or external airflow over the roof (i.e., the shape of the ventilator along with the orientation of the louvers can cause a pressure differential that facilitates airflow out of the ventilator). In normal ventilation, air flows through the filter device 28 as indicated by the arrow 52. The air passes through the filter device 28 and then through the louvers 24, as indicated by an arrow 50.

Because the airflows and pressure differentials involved with ventilation are relatively small compared to those experienced during extreme weather conditions, it is desirable that the filter device impedes the ventilation airflow as little as possible while still providing the desired infiltration protection. Therefore, in accordance with the present invention, filter device 28 is formed into a relatively narrow band or strip of fibrous material. In conjunction with the internal louvers (e.g., louvers 24A), the relatively narrow width of the band is sufficient to achieve infiltration performance to meet current extreme weather building codes while minimizing obstruction of ventilation airflow out of the roof. In one embodiment, the band is about 1.25 inches wide, but the width can be smaller or larger, depending on the density of the filter material, louver performance, and building code infiltration requirements. In view of the present disclosure, those skilled in the art can determine the suitable filter parameters to meet these requirements. The filter thickness preferably matches the height of the louvers. One advantage of this embodiment is that the louvers tend to filter out solid matter so that the filter device will not become clogged. Under extreme weather conditions when water may leak past the louvers, the filter device prevents this water from leaking into the roof ridge opening.

In infiltration operation (i.e., when conditions tend to cause air to flow into the roof ventilator), as air passes through the openings 34 of the louvers 24A, this air is deflected upward, following a course in the opposite direction of the arrow 50. As a result, the free area through which air is permitted to pass is minimized, thereby substantially reducing both the velocity and infiltration of foreign matter of air passing through the louvers 24A.

After air passes through the louvers 24A, this air passes through the filter device 28, following a course that is opposite that of the arrow 52. The filter device 28 further reduces passage of airborne foreign matter through the roof ventilator 20. As a result, airborne matter within air passing through the roof ventilator 20 is filtered out through the louvers 24A and the filter device 28. As previously described, the louvers 24A and the filter device 28 operate together to meet current extreme weather building codes while minimizing obstruction of ventilation airflow out of the roof.

Figure 4:
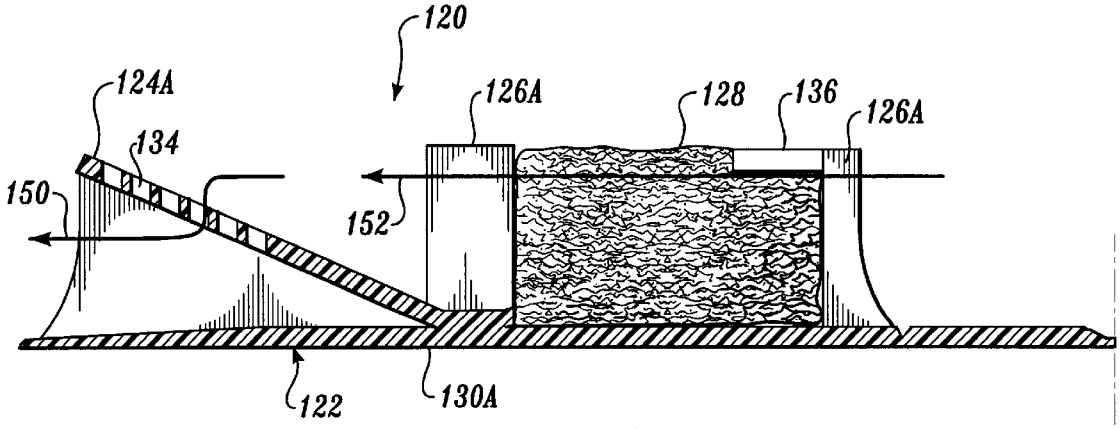
FIG. 4 is a cross-sectional end view of a roof ventilator formed in accordance with another embodiment of the present invention, showing alternative attachment of the filter device.

Referring now to FIG. 4, an alternate embodiment of a roof ventilator 120 formed in accordance with the present invention is illustrated. The roof ventilator 120 of this alternate embodiment is substantially identical in materials and operation as roof ventilator 20 (FIG. 3) described above, except that roof ventilator 120 includes a retainer 136. Except for retainer 136, the reference numbers used in describing features and elements of roof ventilator 120 are the same as those of roof ventilator 20 (FIG. 3), but preceded by a numeral "1" so that the description of roof ventilator 20 can be easily applied to roof ventilator 120. Attachment of the filter device 128 may be had by a retainer 136 extending normally from the free end of the inboard row of supports 126. The retainer 136 extends outboard from the free end of the inboard row of supports 126 to further assist in retaining the filter device 128 within the roof ventilator 120.

Figure 4A:
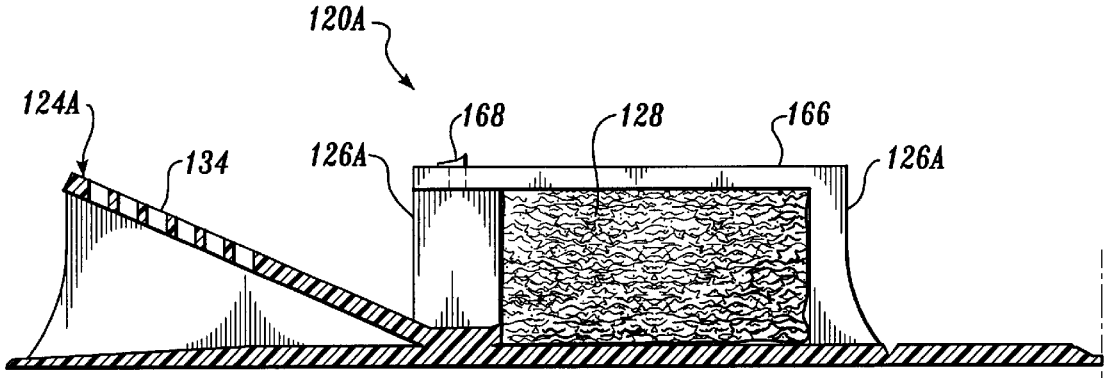
FIG. 4A is a cross-sectional end view of a roof ventilator formed in accordance with another embodiment of the present invention, showing other alternative attachment of the filter device.

FIG. 4A illustrates a roof ventilator 120A that is substantially similar to roof ventilator 120 (FIG. 4), except that roof ventilator 120A has a retainer 166 that extends to the opposite support 126 (adjacent to louver 124*a*) instead of the shorter retainer 136 (FIG. 4). Support 126A includes a fitting 168 that fits into a slot (not shown) on retainer 166. In this embodiment, the fitting 168 has the shape of a tapered or angled flange and is formed from a substantially rigid yet resilient material. The flange is formed so that one side is tapered toward the distal end of the fitting 168 but the other side facing cover member 122 is flat. The resilient material and tapered side of the flange allows the fitting 168 to be fitted through the slot in retainer 166, while the flat side of the flange prevents the retainer 166 from being moved away from support 126A. This feature further aids in retaining filter device 128 in roof ventilator 120A. Further, this feature can advantageously eliminate the need for adhesive to bond filter device 128 to the cover member 122. Alternatively, the fitting 168 and the slot may be formed on the retainer 166 and support 126A, respectively.

Figure 4B:
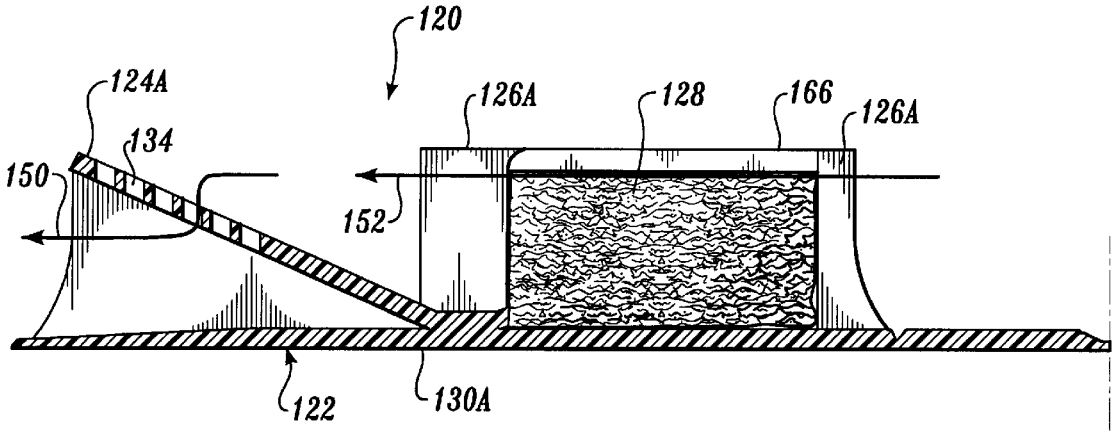
FIG. 4B is a cross-sectional end view of a roof ventilator formed in accordance with another embodiment of the present invention, showing yet another alternative attachment of the filter device.

FIG. 4B shows another alternative embodiment similar to that of FIG. 4A except that the retainer 155 does not overlap the support 126A. Instead, in this embodiment, the retainer 166 is formed as integrally with support 126 and is folded over so that the end of the retainer 166 contacts the support 126A. In this embodiment, a lip 170 is formed on the support 126A. In this embodiment, the lip 170, the retainer 166, and the supports 126 and 126A are formed from a resilient material, such as a plastic or polymer, that allows the retainer 166 to be bent over past the lip 170 after the filter device 128 is placed between the supports 126 and 126A. That is, the end of the retainer 166 is forced past the lip 170 to be "snapped" into place, contacting and flush with the support 126A. The retainer 166 together with the lip 170 serve to hold the filter device 128 in place.

Figure 5:
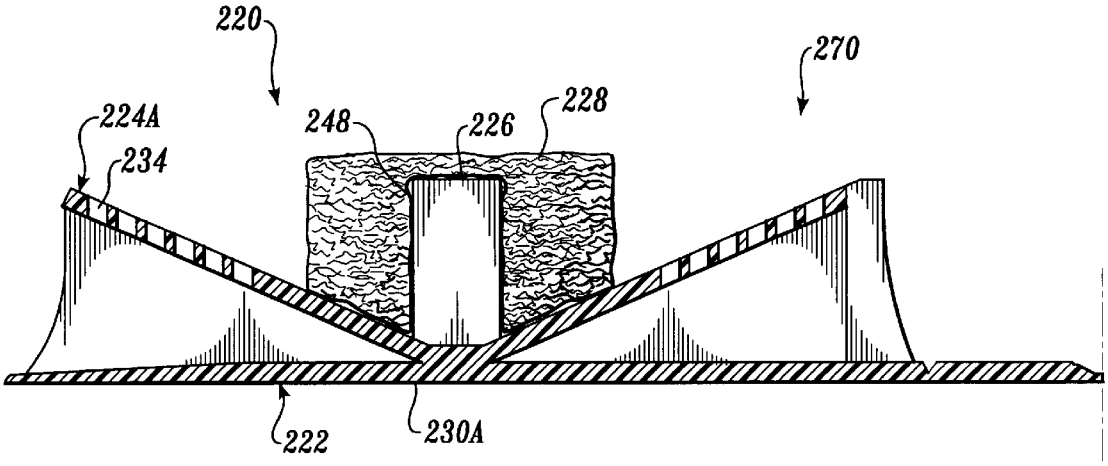
FIG. 5 is a cross-sectional end view of a roof ventilator formed in accordance with another embodiment of the present invention, showing alternative placement and attachment of the filter device.

Referring now to FIG. 5, a second alternate embodiment of a roof ventilator 220 formed in accordance with the present invention is illustrated. The roof ventilator 220 is identical in materials and operation as the embodiment described above with the following exceptions described below. Except for the second set of louvers 270, the reference numbers used in describing features and elements of roof ventilator 220 are the same as those of roof ventilator 20 (FIG. 3), but preceded by a numeral "2" so that the description of roof ventilator 20 (FIG. 3) can be easily applied to roof ventilator 220.

In this alternate embodiment, a second set of louvers 270, a mirror image of the first set of louvers 228*a*, is located in a V-shaped configuration, such that the second set of louvers 270 extend from the base of the outboard set of supports at a predetermined angle to intersect the inboard set of supports. In this embodiment, the angle is about 25°, but any angle up to 90° can be used depending on the height and intersection point of the outboard set of supports. In this embodiment, the band of fibrous material for the filter device 228 includes slits 248 that are cut to a depth that is substantially equal to the height of the support, or deeper, or even all the way through the filter device 228. The slits 248 run longitudinally and are suitably cut at a distance spaced from each other equal to the distance between each support. The filter device 228 is attached over the supports, with the slits 248 fitting snugly over each support 226. Alternatively, the filter device may be attached to the cover member adjacent to or in the second set of louvers so that airflow into the roof ventilator must pass through two sets of louvers before flowing through the filter device.

Figure 6:
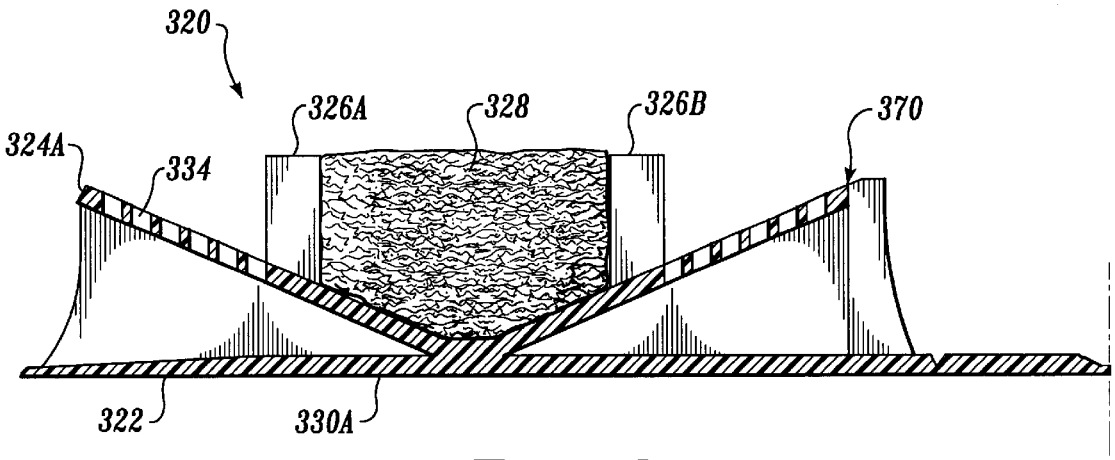
FIG. 6 is a cross-sectional end view of a roof ventilator formed in accordance with another embodiment of the present invention, showing other alternative placement and attachment of the filter device.

FIG. 6 illustrates a roof ventilator 320 formed in accordance with another embodiment of the present invention. The roof ventilator 320 is identical in materials and operation as roof ventilator 220 (FIG. 5) described above except that the single row of supports 226 adjacent to louvers 224A is replaced with two rows of supports 326A and 326B. Except for these supports, the reference numbers used in describing features and elements of roof ventilator 320 are the same as those of roof ventilator 220 (FIG. 5), but incremented by 100, so that the description of roof ventilator 220 (FIG. 5) can be easily applied to roof ventilator 320.

In this alternate embodiment, the row of supports 326A is formed on part of the first set of louvers 324A while the other row of supports 326B is formed on the second set of louvers 370. In this embodiment, the band of fibrous material for the filter device 328 is disposed between the rows of supports 326A and 326B. The filter device can be attached to the roof ventilator 320 by adhesive or mechanical fasteners. In a further refinement, retainers (not shown) as described above in conjunction with FIGS. 4 and 4B can be added.

Figure 6A:
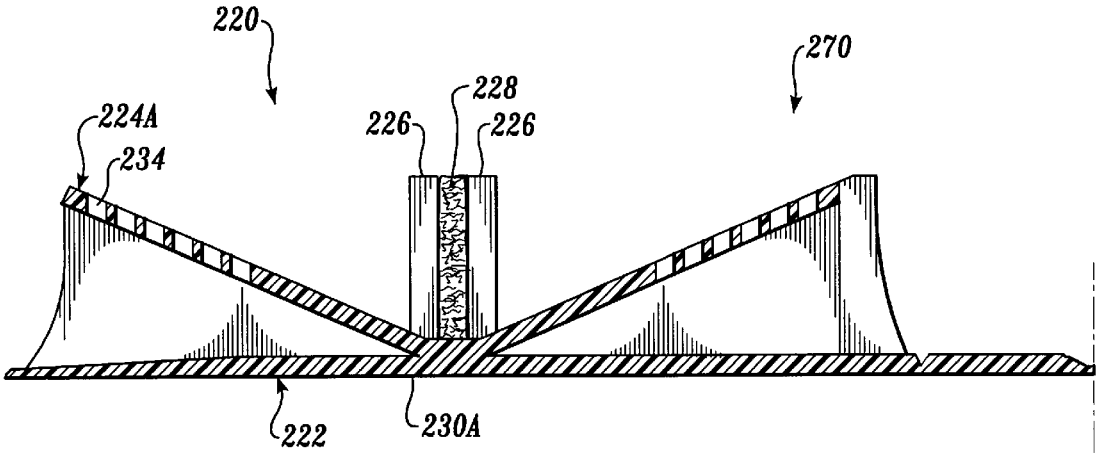
FIG. 6A is a cross-sectional end view of a roof ventilator formed in accordance with yet another embodiment of the present invention, showing another alternative placement and attachment of the filter device.

FIG. 6A illustrates a refinement of the embodiment of FIG. 6, with the supports 326A and 326B placed closer together. In this embodiment, the supports 326A and 326B are about 0.5 inches apart, although other distances can be used in other embodiments as required to match the width of the filter device. The fibrous material of the filter device 328 is placed between the supports. It is believed that the two sets of louvers in this embodiment allow the filter device 228 to be relatively narrow while still achieving the desired infiltration protection.

Figure 7:
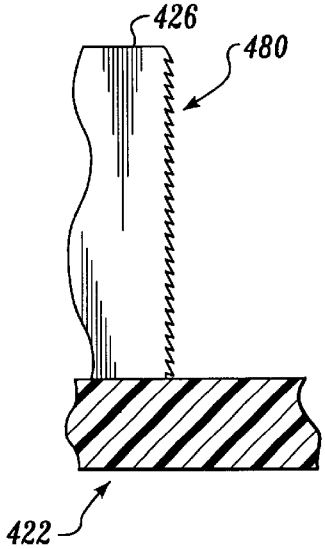
FIG. 7 is a cross-sectional end view of a support of a roof ventilator formed in accordance with another embodiment of the present invention, showing sidewall serrations.

FIG. 7 illustrates a support 426 formed in accordance with another embodiment of the present invention. As shown in FIG. 7, support 426 includes serrations 480 along a sidewall. The serrations 480 can have a spine-like, barb-like, spike-like shape, etc., with sharp points directed generally toward the cover member 422. When the roof filter is assembled, the filter device (omitted for clarity) is adjacent to and contacting the serrations 480 of the support 426. The serrations 480 tend to allow the filter device to move towards cover member 422 during assembly. In addition, the serrations 480 tend to prevent the filter device from moving away from cover member 422 by becoming enmeshed in the fibrous material of the filter device, thereby helping to fasten the filter device securely to the support 426. These serrations can be provided in one or more of the supports of the embodiments depicted in FIGS. 3–6.

From the foregoing descriptions, it may be seen that a roof ventilator formed in accordance with the present invention incorporates many novel features and offers significant advantages over currently available roof ventilators. While the presently preferred embodiments of the invention have been illustrated and described, it is to be understood that within the scope of the appended claims, various changes can be made therein without departing from the spirit and scope of the invention.

I claim:

1. A roof ventilator, comprising:

a cover member including a first surface over which shingles are secured and a second surface;

a first vent secured to the second surface of the cover member, the first vent having a first set of louvers, the first set of louvers being covered by the cover member when the roof ventilator is installed on a roof, and the first set of louvers comprising openings extending therethrough, the openings deflecting infiltrating air through about a right angle in a direction about normal to the plane of the cover member;

a plurality of supports extending from the second surface of the cover member at a height substantially equal to that of the first set of louvers; and a filter coupled to the second surface of the cover member disposed between the center of the cover member and the first set of louvers.

2. The roof ventilator of claim 1, wherein the filter comprises a band of fibrous material formed from coated natural fibers.

3. The roof ventilator of claim 2, wherein the band of fibrous material includes a plurality of slits, the plurality of supports being fitted into the plurality of slits in the fibrous material.

4. The roof ventilator of claim 1, wherein one or more supports of the plurality of supports include retainers extending from the end of the supports and over the filter device.

5. The roof ventilator of claim 4, wherein the retainers contact corresponding supports of a second plurality of supports, the second plurality of supports extending from the second surface of the cover member.

6. The roof ventilator of claim 1, further comprising a second set of louvers disposed between the center of the cover member and the plurality of supports.

7. The roof ventilator of claim 6, wherein the filter is disposed between the first and second set of louvers.

8. A roof ridge ventilator comprising:

an elongate cover member having a first surface and a second surface;

a first set of louvers attached to the second surface of the cover member and disposed along one side of the cover member, the first set of louvers having a height, and comprising openings extending therethrough, the openings deflecting infiltrating air through about a right angle in a direction about normal to the plane of the cover member;

a plurality of supports extending from the second surface of the cover member and at a height substantially equal to that of the height of the first set of louvers; and a strip of fibrous material disposed adjacent to the first set of louvers and the plurality of supports.

9. The ridge roof ventilator of claim 8, wherein the strip of fibrous material comprises natural fibers.

10. The ridge roof ventilator of claim 9, wherein the strip of fibrous material includes a matting.

11. The ridge roof ventilator of claim 8, wherein one or more supports of the plurality of supports include serrations configured to grip the fibrous material of the strip.

12. The roof ridge of claim 8, further comprising a second set of louvers attached to the second surface of the cover member and located between the first set of louvers and the center of the cover member.

13. The roof ventilator of claim 12, wherein the strip of fibrous material is disposed between the first and second set of louvers.

14. A roof ventilator for use on a roof having an opening, the roof ventilator comprising:

a cover member of elongated shape including a pair of flaps, each flap having an upper surface over which cap shingles are secured and having a downwardly facing lower surface, wherein said cover member contains a longitudinal groove located centrally between the two outer edges of the flaps, the groove allowing the angle between the pair of flaps to be varied to accommodate roofs with various pitches; and a pair of vents respectively secured to the lower surface of the flaps, each vent having a first set of louvers, the first set of louvers comprising openings extending therethrough, the openings deflecting infiltrating air through about a right angle in a direction about normal to the plane of the cover member, and wherein each flap includes:

a first plurality of supports spaced longitudinally on the flap and extending from the lower surface of the flap, the first plurality of supports being located between the first set of louvers and the groove;

a second plurality of supports spaced longitudinally on the flap and extending from the lower surface of the flap, the second plurality of supports being located between the first set of louvers and the groove; and a band of fibrous material disposed between the first and second pluralities of supports.

15. The roof ventilator of claim 14, wherein one or more supports of the first plurality of supports includes a retainer, each retainer extending from the end of the support and over the band of fibrous material.

16. The roof ventilator of claim 15, wherein the retainers contact corresponding supports of the second plurality of supports.

17. The roof ventilator of claim 14, wherein the fibrous material comprises natural fibers.

18. The roof ventilator of claim 14, wherein supports of the first and second pluralities of supports include serrations contacting the fibrous material.

19. The roof ventilator of claim 14, wherein each flap includes a second set of louvers located between the first set of louvers and the groove.

* * * * *